US008740648B2

(12) United States Patent
Zhang

(10) Patent No.: US 8,740,648 B2
(45) Date of Patent: Jun. 3, 2014

(54) CARD CONNECTOR WITH REINFORCING PLATES

(75) Inventor: Wei-De Zhang, Shenzhen (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 96 days.

(21) Appl. No.: 13/241,257

(22) Filed: Sep. 23, 2011

(65) Prior Publication Data

US 2012/0122340 A1 May 17, 2012

(30) Foreign Application Priority Data

Nov. 16, 2010 (CN) ..... 2010 2 0610371

(51) Int. Cl.
*H01R 13/648* (2006.01)

(52) U.S. Cl.
USPC ..... 439/607.33

(58) Field of Classification Search
USPC ..... 439/607.33, 607.32, 607.31, 607.35, 439/607.4, 630, 64, 377
See application file for complete search history.

(56) References Cited

U.S. PATENT DOCUMENTS

| | | | | |
|---|---|---|---|---|
| 6,319,060 | B1 * | 11/2001 | Wu | 439/607.13 |
| 6,439,926 | B1 * | 8/2002 | Kuan | 439/607.4 |
| 6,478,630 | B1 * | 11/2002 | Hsu | 439/680 |
| 6,685,509 | B1 * | 2/2004 | Yeh | 439/607.22 |
| 6,811,439 | B1 * | 11/2004 | Shin-Ting | 439/607.31 |
| 6,811,443 | B2 * | 11/2004 | Machihara et al. | 439/630 |
| 6,929,510 | B2 * | 8/2005 | Pan | 439/607.31 |
| 7,008,262 | B2 * | 3/2006 | Tsai | 439/541.5 |
| 7,014,481 | B2 * | 3/2006 | Miyamoto | 439/95 |
| 7,070,430 | B2 * | 7/2006 | Yang et al. | 439/159 |
| 7,083,446 | B2 * | 8/2006 | Tanaka et al. | 439/159 |
| 7,210,950 | B2 * | 5/2007 | Tanaka et al. | 439/188 |
| 7,244,149 | B1 * | 7/2007 | Wang | 439/629 |
| 7,404,727 | B1 * | 7/2008 | Lee et al. | 439/326 |
| 7,431,618 | B2 * | 10/2008 | Jin | 439/630 |
| 7,442,044 | B2 * | 10/2008 | Yang et al. | 439/64 |
| 7,530,852 | B2 * | 5/2009 | Hu et al. | 439/630 |
| 7,540,778 | B2 * | 6/2009 | Cheng | 439/607.22 |
| 7,549,896 | B2 * | 6/2009 | Zhang et al. | 439/607.01 |
| 7,614,912 | B2 * | 11/2009 | Cheng | 439/607.31 |
| 7,661,989 | B1 * | 2/2010 | He et al. | 439/607.33 |
| 7,682,194 | B2 * | 3/2010 | Lin et al. | 439/607.31 |
| 7,753,723 | B2 * | 7/2010 | Ting | 439/541.5 |
| 7,837,507 | B1 * | 11/2010 | Yang et al. | 439/607.31 |
| 7,914,330 | B2 * | 3/2011 | Su et al. | 439/607.31 |

(Continued)

FOREIGN PATENT DOCUMENTS

CN 201829665 U 5/2011

*Primary Examiner* — Amy Cohen Johnson
*Assistant Examiner* — Vladimir Imas
(74) *Attorney, Agent, or Firm* — Wei Te Chung; Ming Chieh Chang

(57) ABSTRACT

A card connector (100) includes an insulative housing (2) having a base portion (21) and a pair of opposite sidewalls (22) extending upwardly from the base portion, a number of contacts (3) retained in the base portion, a pair of rigid reinforcing plates (4) each comprising a horizontal wall (42) insert-molded in the base of the insulative housing and a vertical wall (41) attached to the sidewall of the insulative housing, and a metal shield (1) having a main portion (11) and at least two lateral walls (12). The vertical wall includes a number of protrusions (411). Said lateral wall defines a number of cutouts (121) receiving the protrusions. The metal shield cooperates with the insulative housing and the reinforcing plates for defining a card receiving space.

9 Claims, 4 Drawing Sheets

(56) References Cited

U.S. PATENT DOCUMENTS

| | | | | |
|---|---|---|---|---|
| 7,938,684 | B2 * | 5/2011 | Lin | 439/607.4 |
| 7,972,170 | B2 * | 7/2011 | Tsujimoto | 439/541.5 |
| 8,011,965 | B2 * | 9/2011 | Zhang | 439/630 |
| 8,038,477 | B2 * | 10/2011 | Zhang | 439/630 |
| 8,100,719 | B2 * | 1/2012 | Ouyang et al. | 439/607.33 |
| 8,292,642 | B1 * | 10/2012 | Lee et al. | 439/159 |
| 2005/0221649 | A1 * | 10/2005 | Tanaka et al. | 439/159 |
| 2007/0111603 | A1 * | 5/2007 | Wang | 439/630 |
| 2007/0287312 | A1 * | 12/2007 | Yu et al. | 439/160 |
| 2008/0280487 | A1 * | 11/2008 | Ting | 439/541.5 |
| 2011/0070760 | A1 * | 3/2011 | Zhang | 439/159 |
| 2011/0151721 | A1 * | 6/2011 | Zhang | 439/630 |
| 2011/0250772 | A1 * | 10/2011 | Zhang | 439/159 |
| 2012/0129370 | A1 * | 5/2012 | Zhou et al. | 439/188 |
| 2012/0295481 | A1 * | 11/2012 | Zhang | 439/607.22 |

* cited by examiner

CARD CONNECTOR WITH REINFORCING PLATES

BACKGROUND OF THE INVENTION

1. Field of the Invention

The present invention relates generally to a card connector, and more particularly to a SIM (Subscriber Identity Module) card connector with reinforcing plates for intensifying the insulative housing and therefore, preventing warping of the insulative housing.

2. Description of Related Arts

A SIM card connector usually includes an insulative housing, a plurality of contacts retained in the insulative housing, and a metal shield covering the insulative housing. The insulative housing includes a base portion and a pair of sidewalls extending upwardly from two opposite edges of the base portion. Each sidewall forms a plurality of protrusions. The metal shield comprises a main portion and a pair of lateral walls extending downwardly from two edges of the main portion. Each lateral wall defines a plurality of cutouts correspondingly receiving the protrusions of the insulative housing and therefore, the metal shield is secured on the insulative housing. The contacts are soldered on a printed circuit board for electrical connection. During a soldering process, high temperature is always needed and high temperature may cause warping of the insulative housing. Therefore, the protrusions of the insulative housing are deformed in the cutouts of the metal shield. The metal shield may even be difficult to be separated from the insulative housing for repairing purpose because the cutouts and the protrusions are seriously deformed.

Hence, a card connector with strengthened insulative housing, preventing warping of the insulative housing, and the metal shield thereof being easily separable from the insulative housing when repair is necessary is desired.

SUMMARY OF THE INVENTION

Accordingly, an object of the present invention is to provide a card connector with strengthened insulative housing, preventing warping of the insulative housing, and the metal shield thereof being easily separable from the insulative housing when repair is necessary.

To achieve the above object, a card connector includes an insulative housing having a base portion and a pair of opposite sidewalls extending upwardly from the base portion, a number of contacts retained in the base portion, a pair of rigid reinforcing plates each comprising a horizontal wall insert-molded in the base of the insulative housing and a vertical wall attached to the sidewall of the insulative housing, and a metal shield having a main portion and at least two lateral walls. The vertical wall includes a number of protrusions. Said lateral wall defines a number of cutouts receiving the protrusions. The metal shield cooperates with the insulative housing and the reinforcing plates for defining a card receiving space.

Other objects, advantages and novel features of the invention will become more apparent from the following detailed description when taken in conjunction with the accompanying drawings.

DETAILED DESCRIPTION OF THE PREFERRED EMBODIMENT

Figure 1:
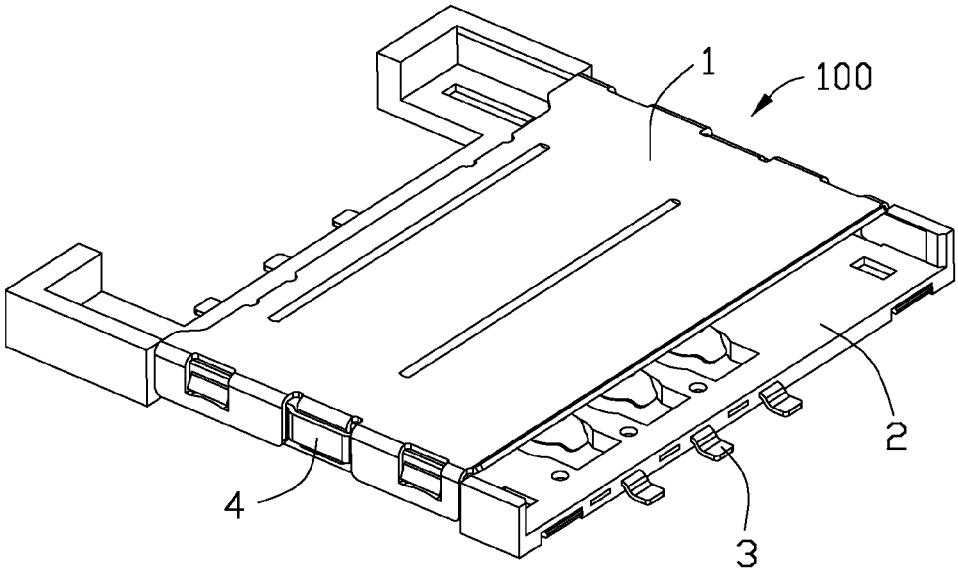
FIG. 1 is a perspective, assembled view of a card connector constructed in accordance with the present invention.

Reference will now be made in detail to the preferred embodiment of the present invention.

Referring to FIGS. 1-4, a card connector 100 assembled on a printed circuit board (not shown) for electrical connection in accordance with the present invention, comprises an insulative housing 2 having a base portion 21 and a pair of sidewalls 22 extending upwardly from two opposite edges of the base portion 21, a plurality of contacts 3 retained in the base portion 21 of the insulative housing 2, a pair of reinforcing plates 4 attached to two opposite sides of the insulative housing 2 for increasing intension of the insulative housing 2, and a metal shield 1 secured on the reinforcing plates 4 and cooperating with the insulative housing 2 for defining a card receiving space (not labeled).

Figure 3:
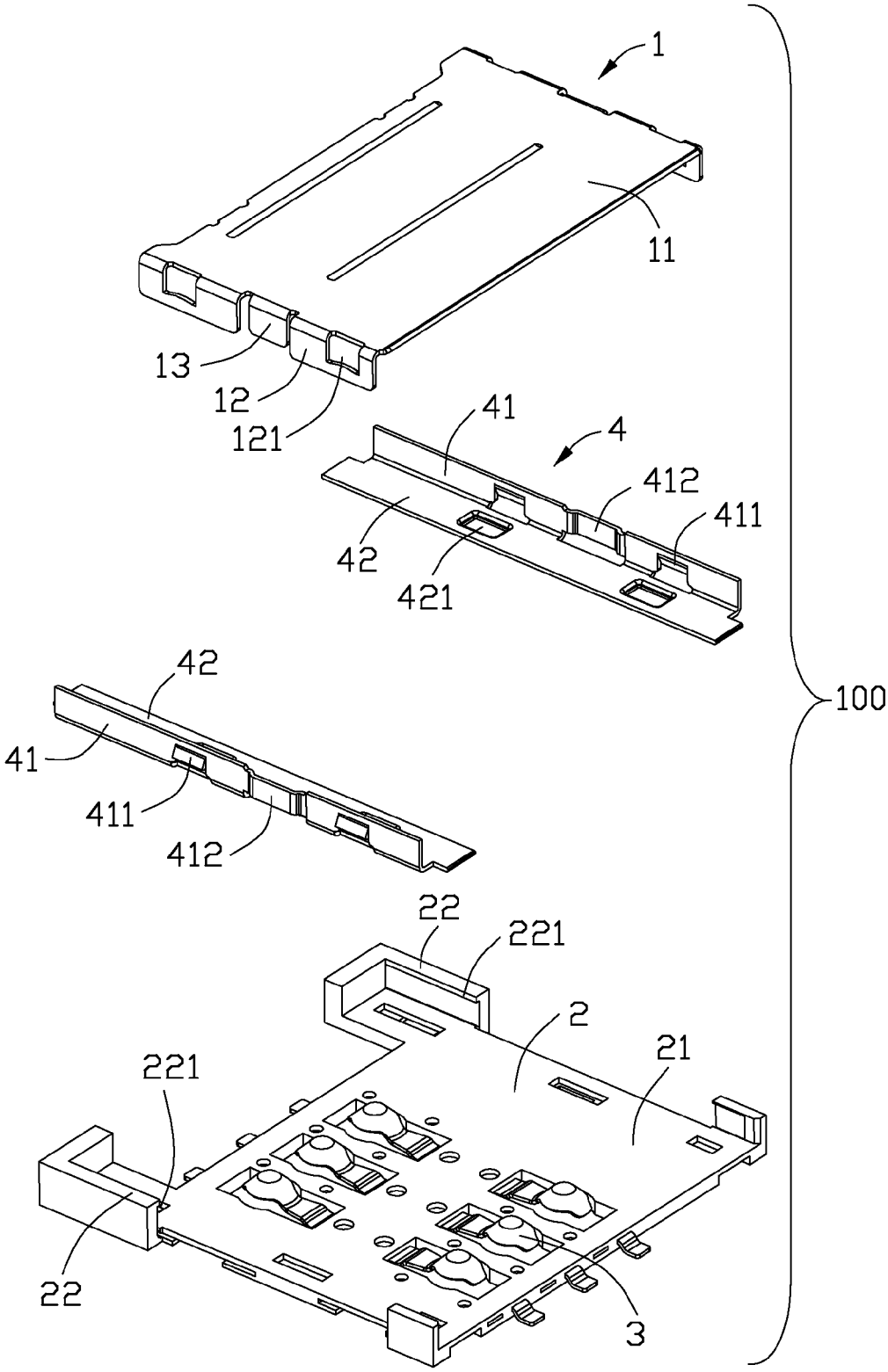
FIG. 3 is a perspective, fully exploded view of the card connector.
Figure 4:
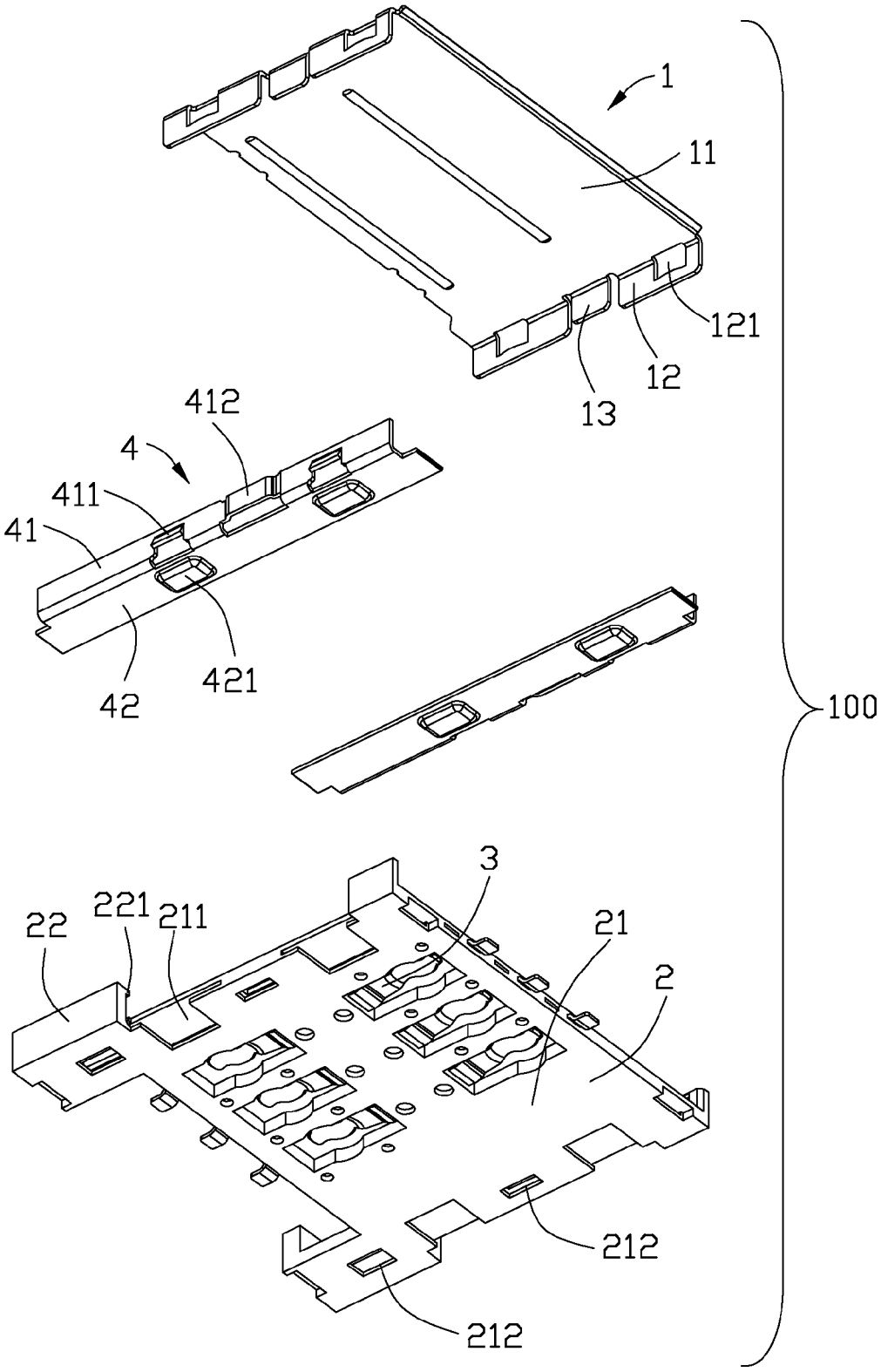
FIG. 4 is another view of FIG. 3.

Referring to FIGS. 3 and 4, the base portion 21 of the insulative housing 2 defines an upper surface (not labeled) facing towards the card receiving space and a lower surface (not labeled) connected to the printed circuit board. The insulative housing 2 defines a plurality of recessed portions 211 at the lower surface thereof and a plurality of slits 212 extending through the upper and lower surfaces thereof In a preferred embodiment, the recessed portions 211 and the slits 212 are both four. The recessed portions 211 and the slits 212 are alternately positioned at two opposite edges of the base portion 21. The slits 212 permits a number of dies (not shown) extending through. The dies are used for positioning the reinforcing plates 4 during insert-molding process. Each sidewall 22 comprises two discrete parts in this embodiment. Each sidewall 22 forms a rib 221 at an inner side thereof.

Figure 2:
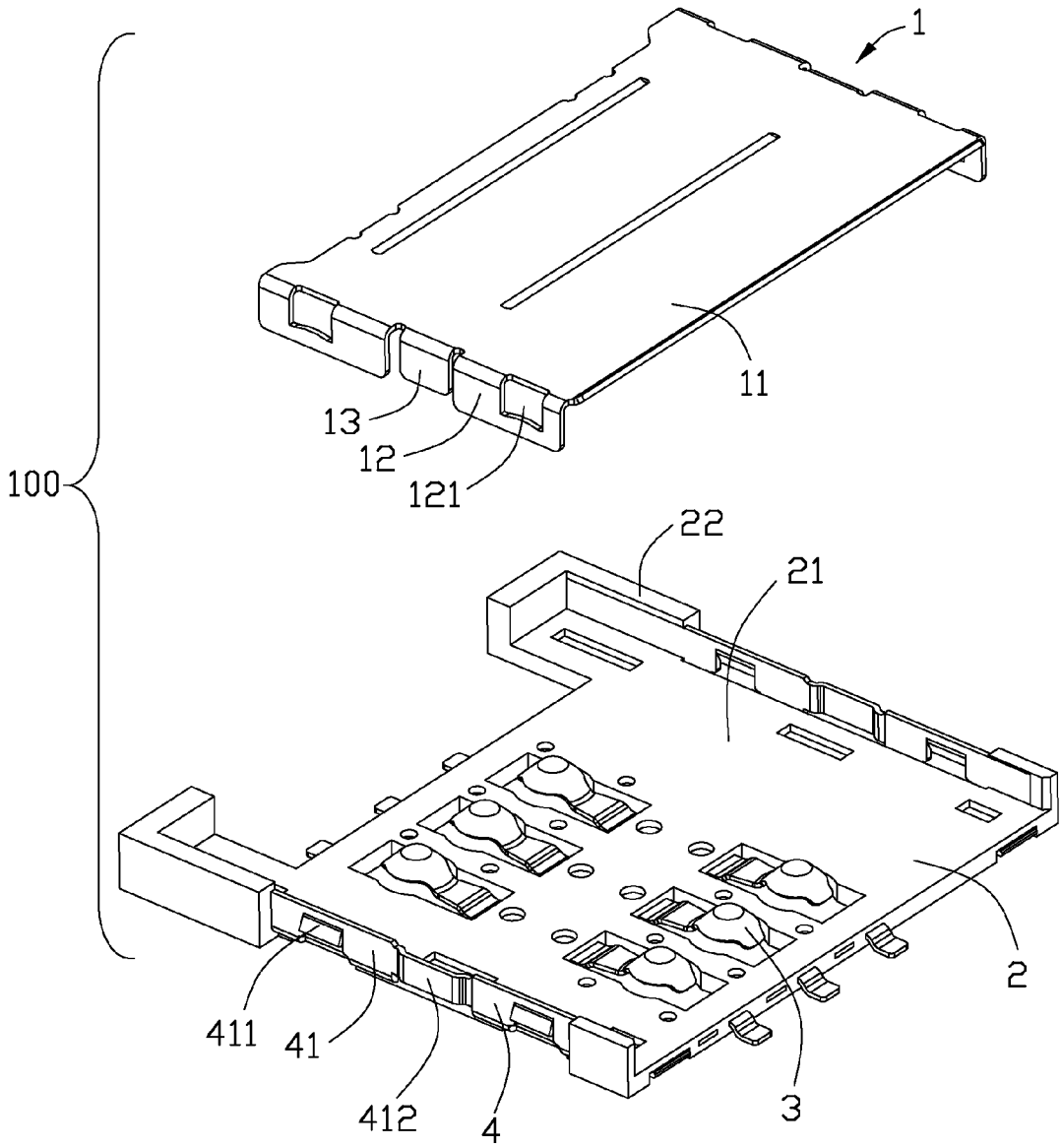
FIG. 2 is a perspective, partly exploded view of the card connector.

Referring to FIGS. 2-4, the reinforcing plates 4 are insert-molded with the insulative housing 2. Each reinforcing plate 4 comprises a vertical wall 41 and a horizontal wall 42 perpendicular to the vertical wall 41. The vertical wall 41 forms a plurality of protrusions 411 extending outwardly. The protrusions 411 are two in a preferred embodiment. The vertical wall 41 further comprises a receiving portion 412 positioned between the protrusions 411. A distance between the opposite receiving portions 412 is larger than that between other parts of the vertical walls 41. The vertical wall 41 is severed from the horizontal wall 42 at respective bottom edges of the protrusions 411 and the receiving portion 412. The horizontal wall 42 forms a plurality of soldering portions 421 which are stamped downwards the printed circuit board. The soldering portions 421 are received in the recessed portions 211 of the insulative housing 2. The vertical wall 41 of the reinforcing plate 4 is positioned between the rib 221 of the sidewall 22 and the base portion 21. The horizontal wall 42 of the reinforcing plate 4 is insert-molded in the base portion 21 of the insulative housing 2. Therefore, the soldering portions 421 are exposed out of the lower surface of the insulative housing 2 via the recessed portions 211. Each reinforcing plate 4 is fixed with the insulative housing 2 for intensifying the insulative housing 2. The protrusions 411 and the receiving portion 412 are exposed through a space between the two discrete parts of the insulative housing 2 for securing with the metal shield 1.

Referring to FIGS. 3 and 4, the metal shield 1 comprises a main portion 11, a plurality of lateral walls 12 extending downwardly from two opposite edges of the main portion 11, and a pair of block portions 13 each positioned between two lateral walls 12 at the same edge of the main portion 11. A distance between the block portions 13 is smaller than that of the opposite lateral walls 12. Each lateral wall 12 defines a cutout 121 correspondingly securing with the protrusion 411 of the reinforcing plate 4. The block portion 13 is attached to an inner side of the receiving portion 412. Therefore, the metal shield 1 is secured on the reinforcing plates 4 via the cutouts 121 and the corresponding protrusions 411, as well as the block portions 13 and the corresponding receiving portions 412. That is to say, each reinforcing plate 4 has two opposite (outer and inner) sides, and the metal shield 1 includes opposite first part, i.e., the lateral wall 12, and second part, i.e., the block portion 13, respectively located by the two opposite sides of the reinforcing plate 4 and commonly sandwiching the reinforcing plate 4.

Because the reinforcing plates 4 are made from rigid material, the reinforcing plates 4 are harder than the metal shield 1. The insulative housing 2 is intensified by the reinforcing plates 4 during its insert-molding with the reinforcing plates 4 and therefore, the insulative housing 2 is prevented from wrapping. The metal shield 1 is indirectly attached to the insulative housing 2 via the reinforcing plates 4. The metal shield 1 is easily separable away from the reinforcing plates 4 during repairing process because the connections between the cutouts 121 and the corresponding protrusions 411, as well as the block portions 13 and the corresponding receiving portions 412 are not deformed even though the contacts 3 are soldered on the printed circuit board under high temperature.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. A card connector comprising:

an insulative housing having a base portion and a pair of opposite sidewalls extending upwardly from the base portion;

a plurality of contacts retained in the base portion;

a pair of rigid reinforcing plates each comprising a horizontal wall insert-molded in the base of the insulative housing and a vertical wall attached to the sidewall of the insulative housing, the vertical wall comprising a plurality of protrusions; and a metal shield having a main portion and at least two lateral walls, said lateral wall defining a plurality of cutouts receiving the protrusions, the metal shield cooperating with the insulative housing and the reinforcing plates for defining a card receiving space, wherein each vertical wall comprises a receiving portion positioned between the protrusions and the metal shield forms a pair of block portions each attached to a corresponding receiving portion.

2. The card connector as claimed in claim 1, wherein each sidewall forms a rib and the vertical wall is positioned between the rib and the base portion.

3. The card connector as claimed in claim 1, wherein a distance between the block portions is smaller than that of the opposite lateral walls and a distance between the opposite receiving portions is larger than that between other parts of the vertical walls.

4. The card connector as claimed in claim 1, wherein each sidewall comprises two discrete parts and the protrusions and the receiving portion are exposed through a space between the two discrete parts.

5. The card connector as claimed in claim 1, wherein the vertical wall is severed from the horizontal wall at respective bottom edges of the protrusions and the receiving portion.

6. A card connector comprising:

an insulative housing having a base portion and a pair of opposite sidewalls extending upwardly from the base portion;

a plurality of contacts retained in the base portion;

a pair of rigid reinforcing plates each comprising a horizontal wall insert-molded in the base of the insulative housing and a vertical wall attached to the sidewall of the insulative housing, the vertical wall comprising a plurality of protrusions; and a metal shield having a main portion and at least two lateral walls, said lateral wall defining a plurality of cutouts receiving the protrusions, the metal shield cooperating with the insulative housing and the reinforcing plates for defining a card receiving space;

wherein the base portion defines an upper surface facing towards the card receiving space, a lower surface opposite to the upper surface and a plurality of recessed portions at the lower surface, and the horizontal wall comprises a plurality of soldering portions received in the recessed portions.

7. The card connector as claimed in claim 6, wherein the soldering portions are exposed out of the lower surface of the insulative housing via the recessed portions.

8. The card connector as claimed in claim 6, wherein the base defines a plurality of slits extending through upper and lower surfaces thereof.

9. An electrical card connector comprising:

an insulative housing defining a horizontal base and two opposite side walls extending upwardly from two side edges of the base to commonly define a card receiving cavity;

a plurality of contacts disposed in the housing with contacting sections thereof extending into the card receiving cavity;

a metallic shell mounted upon the housing to cover the card receiving cavity; and a pair of metallic reinforcement elements associated with the corresponding side walls, respectively; wherein the shell is assembled to the reinforcement elements rather than to the side walls; and wherein each reinforcement element has two opposite sides, and the shell includes opposite first and second parts respectively located by the two opposite sides of the reinforcement element and commonly sandwiching the reinforcement element; and wherein the reinforcement elements are integrally formed with the corresponding side walls, respectively; and wherein material of the reinforcement element is stronger than that of the shell.

* * * * *